United States Patent [19]

Armstrong et al.

[11] Patent Number: 4,477,394

[45] Date of Patent: Oct. 16, 1984

[54] FLUID CONTACT PANEL

[76] Inventors: Charles M. Armstrong, Rte. 3, Box 70, Timpson, Tex. 75975; Eddie D. Duke, P.O. Box 296, Tenaha, Tex. 75974

[21] Appl. No.: 489,367

[22] Filed: Apr. 28, 1983

Related U.S. Application Data

[63] Continuation-in-part of Ser. No. 357,989, Mar. 15, 1982, abandoned.

[51] Int. Cl.[3] ..... B01F 3/04

[52] U.S. Cl. ..... 261/112; 55/241; 210/150; 261/DIG. 11; 428/188

[58] Field of Search ..... 261/94, 112, 153, DIG. 11, 261/DIG. 72; 422/312; 210/150; 55/240, 241; 202/158; 165/166; 428/131, 179, 188, 192

[56] References Cited

U.S. PATENT DOCUMENTS

| | | | |
|---|---|---|---|
| 2,977,103 | 3/1961 | Smith et al. | 261/112 X |
| 3,039,749 | 6/1962 | Kohl et al. | 261/112 |
| 3,189,335 | 6/1965 | Fuller et al. | 261/112 |
| 3,227,429 | 1/1966 | Renzi | 210/150 X |
| 3,329,271 | 7/1967 | Ward et al. | 261/112 X |
| 3,402,105 | 9/1968 | Sze | 261/112 X |
| 3,491,892 | 1/1970 | McCann | 261/112 X |
| 3,704,869 | 12/1972 | Priestley | 261/112 |
| 4,361,426 | 11/1982 | Carter et al. | 261/112 X |

FOREIGN PATENT DOCUMENTS

| | | | |
|---|---|---|---|
| 708310 | 5/1954 | United Kingdom | 261/112 |

*Primary Examiner*—Richard L. Chiesa

*Attorney, Agent, or Firm*—John M. Harrison

[57] ABSTRACT

Extended surface, fluid contact panels which include a plurality of tubular members in generally parallel relationship and spaced in a matrix of thin fins connecting the tubular members to create liquid-gas contact areas on the inside and outside surfaces of the tubular members and the fins. The tubular members and fin matrix are vertically oriented in staggered array with respect to the tower or structure in which the panels are used and in a preferred embodiment, the fins and tubes are tapered and shaped from a plastic material and selected ones of the fins are provided with projecting tabs and matching socket members for connecting the panels in end-to-end relationship and spaced rivet apertures are provided in the fins for accepting rivets to pin the panels in stacked configuration.

11 Claims, 8 Drawing Figures

FLUID CONTACT PANEL

CROSS-REFERENCE TO RELATED APPLICATIONS

This application is a continuation-in-part of co-pending Application Ser. No. 357,989, filed Mar. 15, 1982, and now abandoned.

BACKGROUND OF THE INVENTION

1. Field of the Invention

This invention relates to contacting apparatus for mass and heat transfer operations, and more particularly, to a liquid-gas, extended surface interphase fluid contact medium defined by multiple, shaped, tube-containing interlocking panels for distributing a falling liquid into a thin film in order to provide an extended liquid surface for gas contact with the liquid. Such gas-liquid contact is used in trickle filters, absorption towers, stripping units, cooling towers and other equipment for treating, heating or cooling gases and liquids by contact between the fluids. In order to maximize efficiency, the apparatus used for effecting such gas-liquid contact should be characterized by a high void volume to effect a low resistance to the flow of fluids, a large surface area per unit of volume and a low density in order to provide an extensive contact surface with minimum weight.

2. Description of the Prior Art

Various apparatus are known in the art for providing gas-liquid contact for the purpose of stripping gas of undesirable contaminants, cooling the gas, as in the case of cooling towers used to cool air and other unit operations where it is necessary or desirable to expose a large liquid area in a small volume or in a short distance. Of the prior art devices designed to effect such liquid-gas contact, among the most efficient are the corrugated contact structures, which are constructed of a plastic or paper material to achieve a desirable weight reduction and to satisfy the necessary high void volume and large surface area requirements. However, problems have been experienced with many of these prior art devices, in that the falling liquid tends to "channel" or flow in streams across many of the contact surfaces rather than to completely wet the surfaces. This condition creates dry areas in the structure and reduces contact efficiency. In addition, excessive resistance to the flow of gas upwardly has been encountered in some of the prior art fluid contact designs and many of these structures are not sufficiently strong to permit efficient maintenance.

Typical of the liquid-gas interfacing devices known in the prior art is the contacting arrangement for mass transfer operations disclosed in U.S. Pat. No. 4,107,241, to Roland Braun. This patent discloses a plurality of stacked contacting grates having a first set of parallel strips and a second set of laterally spaced strips arranged in angular relationship with respect to the first set and provided with projections which are stamped from each strip in order to provide a large wetting surface. The plates may be manufactured of metal or of a plastic material and in the latter case, may be formed by injection molding. Another liquid-gas contact device is disclosed in U.S. Pat. No. 3,830,684, to Maurice Hamon, which device includes a corrugated, sheet-type, liquid-gas contact apparatus which includes a plurality of ramp-like deformations which are said to reduce liquid channeling, particularly in the trough portions of the corrugations. Yet another prior art fluid-contact device is disclosed in U.S. Pat. No. 2,793,017, to Douglas E. Lake, entitled "Apparatus for Distributing Falling Liquid in Thin Films." The Lake invention as embodied in this patent includes an assembly of corrugated sheet elements in stacked relationship, to provide an extended fluid contact surface for use in such devices as trickle filters, cooling towers, absorption towers, and the like. According to the disclosure, the corrugated sheet elements can be manufactured from organic thermoplastic sheet material, including a polymer or copolymer of styrene. A similar gas-liquid contacting device is disclosed in U.S. Pat. No. 3,485,485, to Heinz Faigle, which "Cooling Screen" device is characterized by a plurality of sheets having a median longitudinal axis, with corrugations extending in the longitudinal direction on either side of this axis and offset from one another on either side of the longitudinal axis, such that when viewed transversely, the ridge of one of the corrugations is aligned with the valley of another corrugation, the ridges and valleys of the corrugations being equal; when viewed longitudinally, unimpeded passageways are formed between the adjacent sheets. U.S. Pat. No. 3,792,841, to Carl G. Munters discloses a contact apparatus for liquid and gas which includes a contact body having first and second sets of corrugated sheets arranged with the sheets of the first set disposed alternately with sheets of the second set. The sheet corrugations provide channels or passageways which penetrate the contact body from edge to edge, with both the horizontal and vertical components thereof defining a fluted configuration. Another fluid contact device is disclosed in U.S. Pat. No. 3,704,869, to Ronald Priestley, and includes packing sheets comprising spaced, parallel units, each of which is a sector of a hollow, corrugated tube, connected by planar portions of the sheets, the assembled sheets providing a regular array of hollow, corrugated tubes. U.S. Pat. No. 2,977,103, to L. R. Smith, et al, discloses a "Cooling Tower Structure" which includes a rectangular, box-like container, open at the top, the sides and bottom of the container formed of U-shaped wire members positioned by cooperating longitudinal wires. Solid metal sheets define the ends of the container and cooling plates or baffles are placed in the frame in parallel, spaced relationship to achieve the desired fluid contact.

One of the problems associated with many of the prior art liquid-gas interface structures is the relatively great weight of such devices and particularly those which are constructed of metal. Since the supporting structure which contains the contacting material must frequently support more than one layer of the material, the economics of constructing such an apparatus dictate in favor of using materials which are light in weight and yet which provide a high percentage of voids and a large surface area for contacting the liquid and gas. Another problem which is frequently apparent in the use of prior art liquid-gas interfacing apparatus is the lack of sufficient contact surface and voids, a condition which frequently results in an excessive pressure drop across the apparatus itself. In an ideal mass transfer device, the contacting arrangement should ensure that all surfaces available for mass transfer are approximately uniformly wetted and that the entire cross-section is traversed by the gases without unused spaces or voids, such that mass transfer is maximized, with an accompanying low pressure drop in the gas stream.

Furthermore, the device should present a large, extended surface area for wetting by the liquid and the apparatus should be constructed of a wetting material which is light in weight and yet resistant to the corrosive effects of the gas and/or the water or liquid stream. As heretofore described, in many such prior art devices the incoming liquid stream has a tendency to channel or form streams as it traverses the contact apparatus and therefore, does not wet and cover the surfaces of the apparatus to a desired extent. This channeling of the incoming liquid greatly reduces the area available for mass transfer, or the interaction between the gas and the water or other fluid, and lowers the efficiency of the material used as the contacting medium. This undesirable operating condition also results in a substantial reduction in interface contact between the liquid and gas, with a consequential reduction in heat transfer between the fluids.

Accordingly, it is an object of this invention to provide a new and improved tubular matrix medium for effecting efficient contact between fluids and between a gas and a liquid in particular, which medium is characterized by a high percentage of voids, minimum pressure drop in the gas phase, reduced channeling of the downward flowing fluid and a large surface area for effecting good interphase contact between the fluid streams.

Another object of this invention is to provide a new and improved extended surface contact apparatus having multiple, tubular-shaped members in a repeating array for use in cooling or cleaning incoming gas by using a countercurrent, downward movement of water or other liquid, which apparatus is characterized by resistance to corrosion, lightness of weight and an accompanying high percentage of voids and wettable contact surface areas, the surface areas being designed and oriented in a matrix to minimize channeling of the liquid and maximize disposition of a film of liquid on the contact surfaces to maximize the gas-liquid contact efficiency.

A still further object of this invention is to provide a hew and improved, substantially inert contact medium shaped into interlocking panels for interface contact between a gas and a liquid, which medium is characterized by multiple tubular-shaped members arranged in spaced relationship in a matrix array of connecting members, or fins and is light in weight, resistant to corrosion and is further characterized by a high percentage of voids with minimum pressure drop in the gas and a large liquid-gas contact surface area and which can be utilized in substantially any application, including heat and mass transfer operations where contact between a liquid and a gas is desired.

Yet another object of this invention is to provide new and improved, interlocking, liquid-gas contactor panels of selected size and shape which are formed of a thermoplastic or thermoresin material such as polypropylene, and can be quickly and easily joined together in stacked and staggered end-to-end relationship by connecting tabs and rivet means and easily shaped for insertion in a tower, which panels are characterized by a plurality of tapered, thin wall tubes spaced in a regular, recurring, vertical pattern or array in a matrix of thin, tapered, connecting fins and are designed to promote efficient distribution of liquid across the inside and outside surfaces of the tubes and the fins and effect efficient mass and heat transfer between a falling liquid and a rising gas introduced into a tower or structure containing the panels.

Another object of the invention is to provide fluid-contact panels which are characterized by a vertically oriented array of tapered tubes connected by tapered, flat strips containing vertically oriented receiving apertures and cooperating rivets for joining the panels in stacked, staggered orientation and further including horizontally disposed tabs and receiving sockets for connecting the panels in end-to-end relationship.

SUMMARY OF THE INVENTION

These and other objects of the invention are provided in new and improved extended surface fluid contact panels which are characterized by strength, lightness of weight, a high percentage of voids, efficient spacial orientation to maximize filming and reduce channeling of the liquid element and good efficiency in contacting the liquid with the gas to effect interaction between the liquid and gas to the desired extent. In a preferred embodiment of the invention the panels are characterized by multiple, vertically oriented, tapered tubes arranged in a regular recurring pattern or array in a tapered, thin-fin matrix and are manufactured of a thermoplastic material, which panels are capable of being fastened together in end-to-end relationship by means of connecting means including tabs and cooperating receptacles and in stacked and staggered relationship by means of registering apertures and cooperating rivets, to form a fluid contact medium of selected size for specified applications.

BRIEF DESCRIPTION OF THE DRAWINGS

The invention will be better understood by reference to the accompanying drawings, wherein.

DESCRIPTION OF THE PREFERRED EMBODIMENTS

Figure 1:
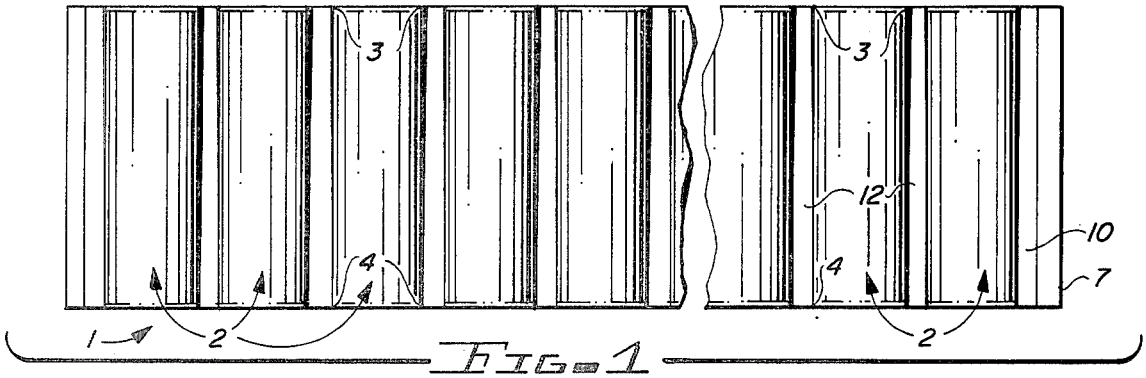
FIG. 1 is a side elevation of a preferred embodiment of the fluid contact panel of this invention.
Figure 2:
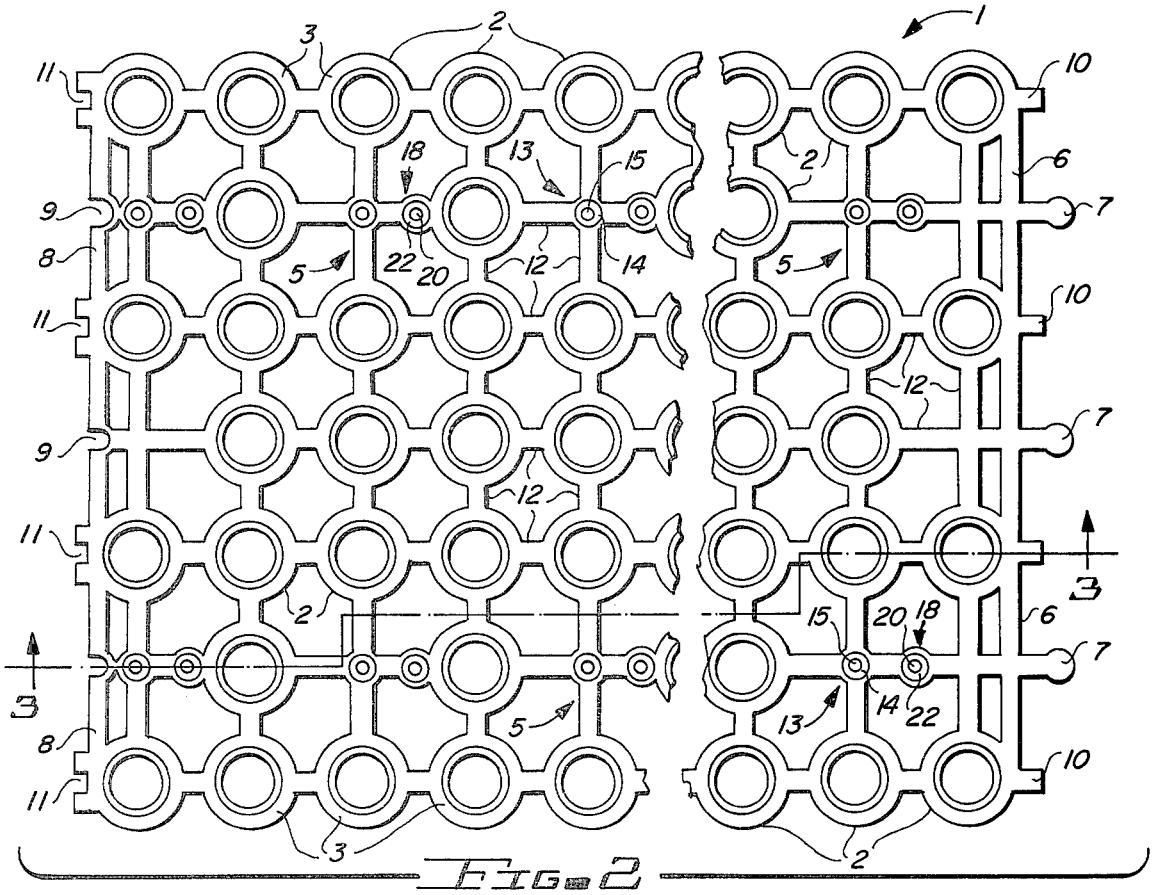
FIG. 2 is a top elevation of the fluid contact panel illustrated in FIG. 1.
Figure 6:
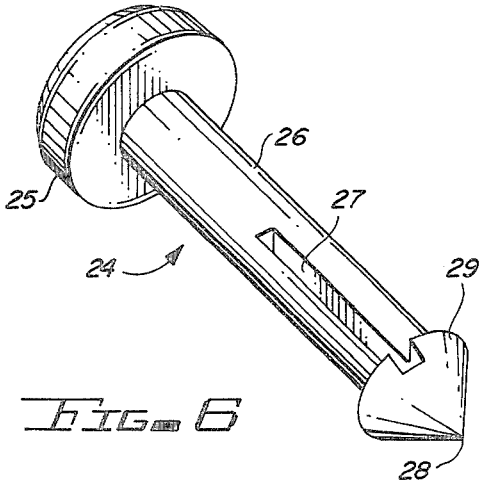
FIG. 6 is a perspective view of a rivet used to join the panels in stacked relationship.
Figure 7:
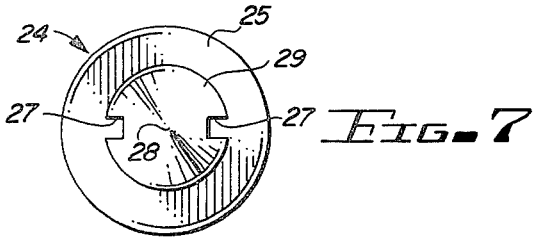
FIG. 7 is a bottom elevation of the rivet.
Figure 8:
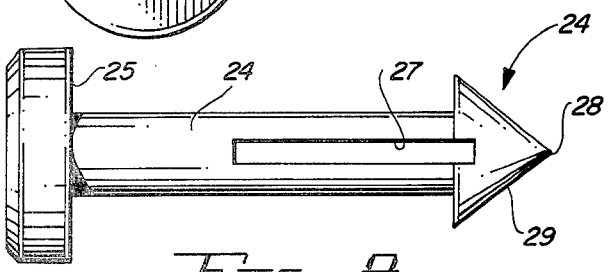
FIG. 8 is a side elevation of the rivet.
Figure 3:
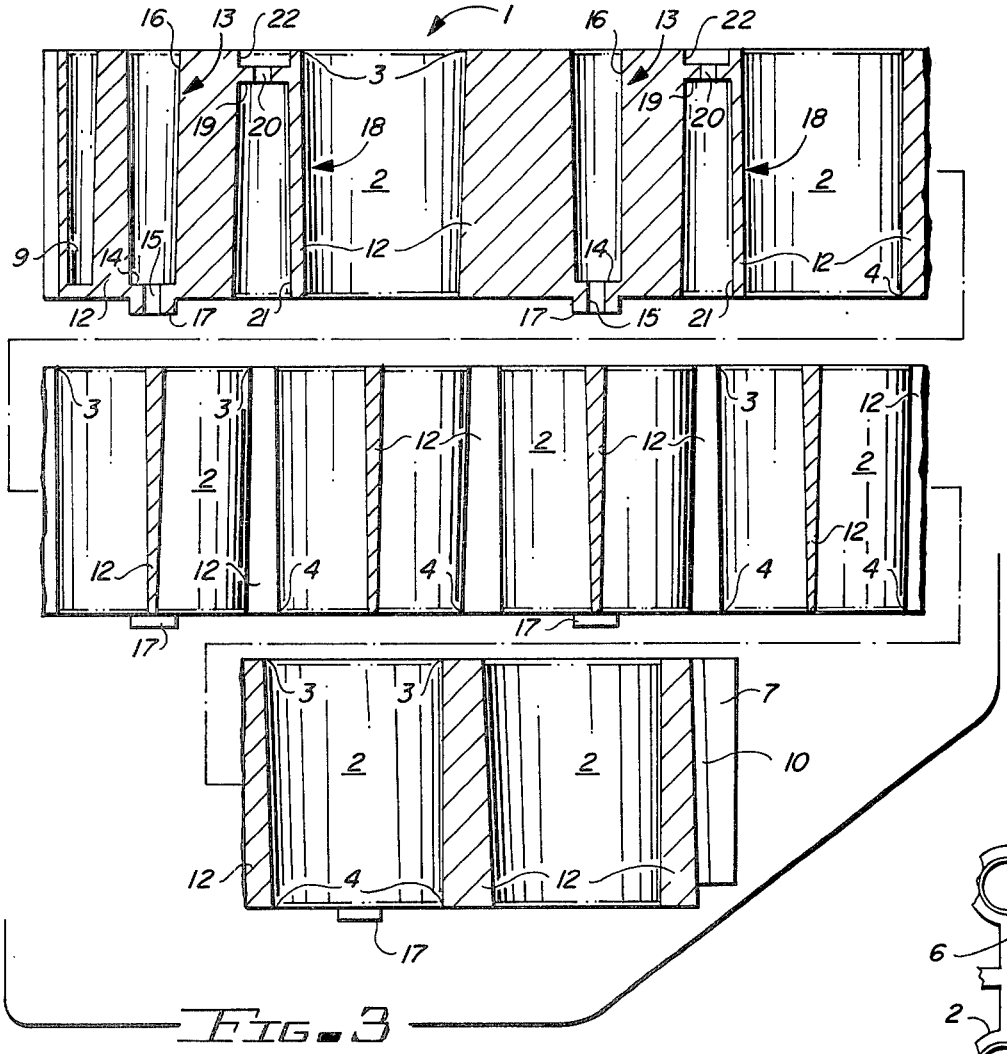
FIG. 3 is a sectional view, taken along lines 3—3 in FIG. 2.
Figure 4:
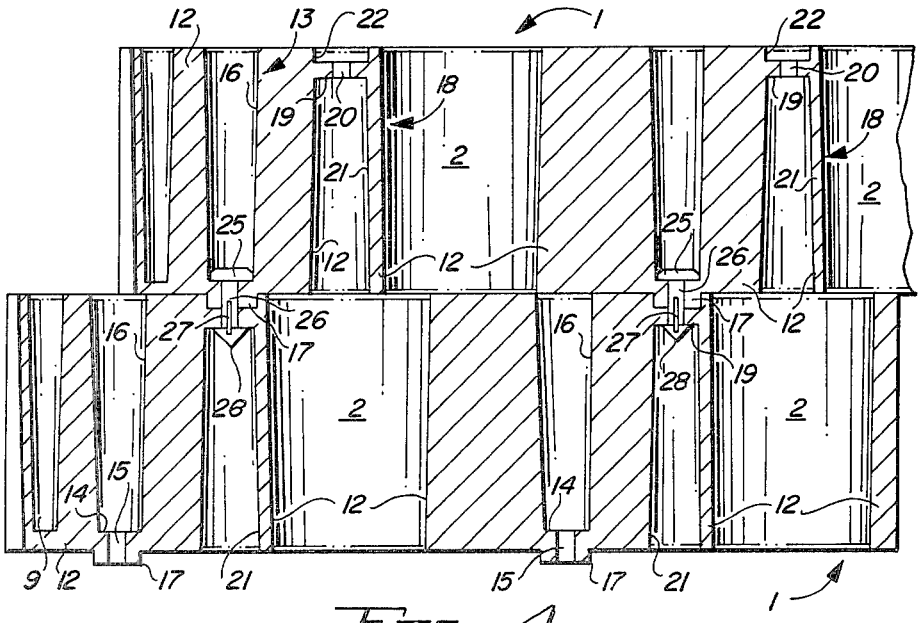
FIG. 4 is a sectional view of two of the fluid contact panels connected in stacked relationship.

Referring now to FIGS. 1–3 of the drawings, the fluid contact panel of this invention is generally illustrated by reference numeral 1 and includes an array of upward standing tubes 2 secured in a matrix 5 of matrix fins 12. The matrix fins 12 support the tubes 2 at four points in spaced relationship and a tab plate 6 extends along one end of the fluid contact panels 1. In a most preferred embodiment of the invention the matrix fins 12 and the tubes 2 are tapered, with a tube top 3 which is larger in diameter than the tube bottom 4, as is more particularly illustrated in FIGS. 2 and 3. In a further most preferred embodiment of the invention tabs 7 extend in spaced relationship from the tab plate 6 and are shaped to mate with corresponding sockets 9, extending from a socket plate 8, positioned on the opposite end of the fluid conduit panels 1 from the tab plate 6, as is illustrated in FIG. 2. In a further preferred embodiment, matrix stubs 10 also project in spaced relationship from the tab plate 6 in each of the fluid contact panels 1 and corresponding receiving stub seats 11 are shaped into the socket plate 8 at corresponding points on the opposite ends of the fluid contact panel 1. The tabs 7 are designed to register with the sockets 9 and the matrix stubs 10 with the stub seats 11, and the fluid contact panels 1 are placed in end-to-end relationship as hereinafter described.

Referring now to FIGS. 2 and 3 of the drawings in yet another preferred embodiment of the invention bottom connectors 13 are provided in spaced relationship in selected matrix fins 12 of the matrix 5 and cooperating top connectors 18 are provided in the matrix fins 12 of the matrix spaced from bottom connectors 13, for cooperation with the bottom connectors 13 to secure the fluid contact panels 1 in staggered, stacked relationship. The bottom connectors 13 each include a bottom seat 14, provided with a bottom seat aperture 15 and a bottom seat access 16, opening to the bottom seat 14. In a most preferred embodiment of the invention the bottom seat access 16 is tapered, narrowing from top to bottom as illustrated in FIG. 3. A bottom seat foot 17 extends beneath bottom seat 14 and from the plane of tube bottoms 4, for registration with a top seat recess 22, provided above each of the top seats 19 of the top connectors 18. A top seat aperture 20 extends through each of the top seats 19 and in a most preferred embodiment of the invention the top seat access 21, which opens to top seat 19, is tapered, narrowing from bottom to top as further illustrated in FIG. 3.

Referring now to FIGS. 4 and 6–8 of the drawings when the fluid contact panels 1 are placed on top of each other in stacked relationship with the bottom seat foot 17 of each of the bottom connectors 13 placed in registration with a corresponding one of the top seat recesses 22 of the top connectors 18, respectively, then the corresponding bottom seat apertures 15 and top seat apertures 20, respectively, are in registration. Rivets 24 can then be inserted in each bottom seat access 16 of the bottom connectors 13 and the tip 28 and rivet body 26 of each of the rivets 24 forced through the bottom seat aperture 15 and the top seat aperture 20, to tightly secure the top fluid contact panel 1 to the bottom fluid contact panel 1, as illustrated. Insertion of the tip 28 and rivet body 26 of the rivets 24, respectively, through the bottom seat aperture 15 and the top seat aperture 20 is easily accomplished because of a slot 27, provided in each rivet body 26, which permits the barb 29 in each tip 28 to collapse inwardly as pressure is applied to the rivet head 25. Accordingly, when the rivets 24 are installed in the configuration illustrated in FIG. 4, each barb 29 and rivet head 25 prevent the rivets 24 from exiting the bottom seat apertures 15 and the top seat apertures 20 of the bottom connectors 13 and the top connectors 18, respectively.

It has surprisingly been found that the tapering of tubes 2 and matrix fins 12, coupled with the corresponding stacked configuration of the fluid contact panels 1 in staggered relationship provides an extremely efficient liquid-gas contact medium for optimizing mass and heat transfer between the fluids. This feature also aids in removing the fluid contact panel 1 from the mold. Referring again to FIG. 4 of the drawings, it will be appreciated that due to the relative positions of the bottom connectors 13 and top connectors 18, when the fluid contact panels 1 are placed in stacked relationship and joined by the rivets 24, the tubes 2 will be oriented in staggered configuration with respect to each other, a condition which minimizes channeling and tends to aid in effecting efficient fluid contact. Accordingly, alternate rows of the fluid contact panels 1 are positioned in staggered relationship to achieve a fluid contact medium of desired thickness in order to maximize this efficiency.

Figure 5:
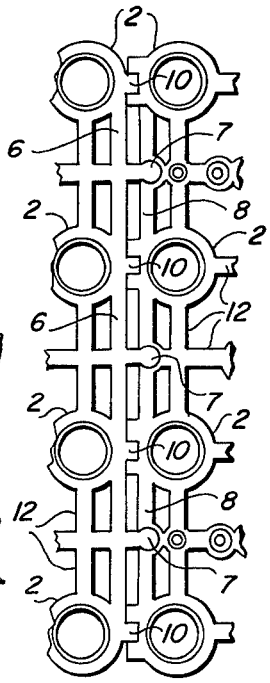
FIG. 5 is a top elevation, partially in section, of two of the fluid contact panels joined in end-to-end relationship.

Referring now to FIG. 5 of the drawings, when it is desired to join the fluid contact panels 1 in end-to-end relationship, the fluid contact panels 1 are aligned with the tabs 7 disposed adjacent the sockets 9 and the tabs 7 are snapped into the sockets 9, to removably, yet securely, join the fluid contact panels 1. Accordingly, it will be appreciated by those skilled in the art that multiple fluid contact panels 1 can be initially joined in end-to-end relationship and subsequently stacked by following the procedure hereinafter outlined with respect to FIGS. 4 and 5 of the drawings. The end-to-end configuration of the fluid contact panels 1 is further secured by registration of the matrix stubs 10, provided on the tab plate 6, with the stub seats 11, shaped on the socket plate 8.

When it is desired to construct a fluid-contact medium or structure of specified size and shape in a tower or other structure using the fluid contact panels 1 according to the teachings of this invention, multiple fluid contact panels 1 are initially joined in end-to-end relationship in a single layer, according to the procedure outlined above with respect to FIG. 5. Rows of this panel composite are then placed in the tower or structure and are shaped by a saw or other means to conform the composite to the shape of the structure. Additional fluid contact panels 1 are then stacked on the bottom array composite of fluid contact panels 1 and are secured to the bottom array in staggered relationship by means of rivets 24, as previously described above with respect to FIG. 4. Multiple rows of the fluid contact panels 1 can therefore be provided to realize a stacked fluid contact medium of desired height and having selected dimensions.

In a most preferred embodiment of the invention the fluid contact panel 1 and the rivets 24 are constructed of a polymerizable material such as polypropylene, polyethylene or a similiar thermoplastic or thermoresin material which, in the case of the fluid contact panel 1, is relatively easily shaped to conform to a tower or vessel of selected design. A preferred technique for constructing the fluid contact panels 1 is by injection molding; however, it will be appreciated that other suitable materials and methods for manufacture of the fluid contact panel of this invention can be used according to the knowledge of those skilled in the art.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. Fluid contact panels comprising an array of hollow, generally tubular-shaped substantially uniformly tapered members of selected length; a plurality of tapered fins spacing said tubular-shaped members; top connecting means and bottom connecting means provided in spaced relationship in selected ones of said tapered fins and fastener means cooperating with said top connecting means and said bottom connecting means for joining selected ones of said panels to each other in stacked relationship; and end connecting means provided at each end of each of said panels for joining selected ones of said panels to each other in end-to-end relationship.

2. The fluid contact panels of claim 1 wherein:

(a) said bottom connecting means further comprises at least one foot extending from the bottom of said selected ones of said tapered fins, a bottom access aperture in said selected ones of said tapered fins and positioned above said foot and a foot aperture in said foot and communicating with said bottom access aperture; and (b) said top connecting means further comprises at least one recess in the top of said selected ones of said tapered fins, a top access aperture in said selected ones of said tapered fins beneath said recess and a recess aperture in that portion of said selected ones of said tapered fins located between said recess and said top access aperture, said recess aperture communicating between said recess and said top acess aperture, whereby said foot in a first one of said panels can be inserted in said recess of a second one of said panels and said fastener means inserted in said bottom access aperture and through said foot aperture and said recess aperture into said top access aperture to join said first one of said panels to said second one of said panels.

3. The fluid contact panels of claim 2 wherein said fastener means further comprises a plurality of plastic rivets, each of said rivets having a head, a body attached to said head at one end of said body and barb means extending from the opposite end of said body.

4. The fluid contact panels of claim 1 wherein:

(a) said bottom connecting means further comprises at least one foot extending from the bottom of said selected ones of said tapered fins, a bottom access aperture in said selected ones of said tapered fins and positioned above said foot and a foot aperture in said foot and communicating with said bottom access aperture;

(b) said top connecting means further comprises at least one recess in the top of said selected ones of said tapered fins a top access aperture in said selected ones of said tapered fins beneath said recess and a recess aperture in that portion of said selected ones of said tapered fins located between said recess and said top access aperture, said recess aperture communicating between said recess and said top access aperture, whereby said foot in a first one of said panels can be inserted in said recess of a second one of said panels and said fastener means inserted in said bottom access aperture and through said foot aperture and said recess aperture into said top access aperture to join said first one of said panels to said second one of said panels; and (c) said fastener means is a plurality of plastic rivets, each of said rivets having a head located in said bottom access aperture, a body extending through said foot aperture and said recess aperture and barb means in said top access aperture to prevent said rivets from exiting said foot aperture and said access aperture when two of said panels are configured in staggered, stacked relationship with said at least one foot of a first selected one of said panels in registration with said at least one recess in a second selected one of said panels.

5. The fluid contact panels of claim 1 wherein said end connecting means further comprises a set of tabs extending in spaced relationship from one end of said panel and a set of sockets provided in said spaced relationship in the opposite end of said panel, whereby said tabs are inserted in said sockets to link a third selected one of said panels to a fourth selected one of said panels in end-to-end relationship.

6. The fluid contact panels of claim 1 wherein:

(a) said bottom connecting means further comprises a plurality of feet extending from the bottom of said selected ones of said tapered fins in spaced relationship; a bottom access aperture in said selected ones of said tapered fins and positioned above each of said feet and a foot aperture in each of said feet and communicating with said bottom access aperture, respectively;

(b) said top connecting means further comprises a plurality of recesses in the top of said selected ones of said tapered fins, a top access aperture in said selected ones of said tapered fins beneath said recess and a recess aperture in that portion of said selected ones of said tapered fins located between each of said recesses and said top access aperture, said recess aperture communicating between each of said recesses and said top access aperture, respectively, whereby said feet in a first one of said panels can be inserted in said recess of a second one of said panel, respectively, and said fastener means inserted in said bottom access aperture and through said foot aperture and said recess aperture into said top access aperture to join said first one of said panels to said second one of said panels; and (c) said end connecting means further comprises a set of tabs extending in spaced relationship from one end of each of said panels and a set of sockets provided in said spaced relationship in the opposite end of each of said panels, whereby said tabs of a third selected one of said panels are inserted in said sockets of a fourth selected one of said panels to link said third selected one of said panels to said fourth selected one of said panels in end-to-end relationship.

7. The fluid contact panel of claim 6 wherein said fastener means further comprises a plurality of plastic rivets, each of said rivets having a head, a body attached to said head at one end of said body and barb means extending from the opposite end of said body.

8. A fluid contact medium comprising a plurality of fluid contact panels arranged in stacked and end-to-end relationship, each of said contact panels comprising:

(a) a plurality of hollow, substantially uniformly tapered tubes in spaced array;

(b) a plurality of tapered fins connecting said tubes at substantially 90 degree spaced intervals and defining a matrix;

(c) a plurality of feet extending from the bottom of said matrix in spaced relationship, a bottom access aperture in said matrix above each of said feet and a foot aperture in each of said feet and communicating with said bottom access aperture, respectively;

(d) a plurality of recesses in the top of said matrix in spaced relationship, a top access aperture in said matrix beneath each of said recesses and a recess aperture communicating between each of said recesses and said top access aperture, respectively, said recesses and said feet provided in staggered relationship in each of said panels, whereby a first selected one of said panels and a second selected one of said panels can be stacked in staggered relationship with said feet in registration with said recesses, respectively; and (e) rivet means inserted in said top and bottom access aperture and in said foot aperture and said recess aperture, respectively, for joining said first and second selected one of said panels.

9. The fluid contact panel of claim 8 further comprising a first set of tabs extending in spaced relationship from one end of each of said panels and a second set of sockets provided in spacd relationship in the opposite end of each of said panels, whereby said tabs of a third selected one of said panels are inserted in said sockets of a fourth selected one of said panels to link said third and fourth selected one of said panels in end-to-end relationship.

10. The fluid contact panel of claim 8 wherein said rivet means each further comprise a body segment, a head attached to one end of said body segment and barb means extending from the opposite end of said body segment, said body fitted into said foot aperture and said recess aperture, said head extending into said bottom access aperture and said barb means extending into said top access aperture, respectively to join said first and second ones of said panels together in stacked relationship.

11. The fluid contact panel of claim 8 comprising a first set of tabs extending in spaced relationship from one end of each of said panels and a second set of sockets provided in spaced relationship in the opposite end of each of said panels, whereby said tabs in a third selected one of said panels are inserted in said sockets in a fourth selected one of said panels to link said third and fourth selected one of said panels in end-to-end relationship, and wherein said rivet means each further comprise a body segment, a head attached to one end of said body segment and barb means extending from the opposite end of said body segment, said body segment fitted into said foot aperture and said recess aperture, said head extending into said bottom access aperture and said barb means extending into said top access aperture, respectively, to join said first and second ones of said panels together in stacked relationship.

* * * * *